US005894293A

United States Patent [19]

Hush et al.

[11] Patent Number: 5,894,293

[45] Date of Patent: Apr. 13, 1999

[54] FIELD EMISSION DISPLAY HAVING PULSED CAPACITANCE CURRENT CONTROL

[75] Inventors: Glen E. Hush, Boise; Russell J. Baker, Meridian, both of Id.

[73] Assignee: Micron Display Technology Inc., Boise, Id.

[21] Appl. No.: 08/637,352

[22] Filed: Apr. 24, 1996

[51] Int. Cl.[6] ..... G09G 3/22

[52] U.S. Cl. ..... 345/74; 345/76

[58] Field of Search ..... 345/74, 75, 76, 345/77, 55, 65, 66, 73, 105, 106; 315/169.1, 169.3, 169.4

[56] References Cited

U.S. PATENT DOCUMENTS

| | | | |
|---|---|---|---|
| 3,564,135 | 2/1971 | Weimer | 315/169.1 |
| 3,723,852 | 3/1973 | Peterson et al. | 323/8 |
| 3,761,617 | 9/1973 | Tsuchiya et al. | 178/7.3 D |
| 3,883,778 | 5/1975 | Kaji et al. | 315/205 |
| 4,020,280 | 4/1977 | Kaneko et al. | 358/242 |
| 4,210,848 | 7/1980 | Suzuki et al. | 345/77 |
| 4,743,096 | 5/1988 | Wakai et al. | 350/333 |
| 4,866,349 | 9/1989 | Weber et al. | 315/169.4 |
| 5,012,153 | 4/1991 | Atkinson et al. | 313/336 |
| 5,036,317 | 7/1991 | Buzak | 340/783 |
| 5,103,144 | 4/1992 | Dunham | 315/366 |
| 5,103,145 | 4/1992 | Doran | 315/381 |
| 5,153,483 | 10/1992 | Kishino et al. | 315/3 |
| 5,162,704 | 11/1992 | Kobori et al. | 315/349 |
| 5,196,839 | 3/1993 | Johary et al. | 340/793 |
| 5,210,472 | 5/1993 | Casper et al. | 315/349 |
| 5,262,698 | 11/1993 | Dunham | 315/169.1 |
| 5,283,500 | 2/1994 | Kochanski | 315/58 |
| 5,313,140 | 5/1994 | Smith et al. | 315/169.1 |
| 5,402,041 | 3/1995 | Kishino et al. | 315/169.1 |
| 5,572,231 | 11/1996 | Kobori | 345/74 |

FOREIGN PATENT DOCUMENTS

| | | | |
|---|---|---|---|
| 0 381 479 A1 | 8/1990 | European Pat. Off. | G09G 3/30 |
| WO 92/05571 | 4/1992 | WIPO | H01J 1/02 |

OTHER PUBLICATIONS

National Television System Committee "NTSC Signal Specifications," *Proceedings of the I–R–E* 42(1): Jan. 17–19, 1954.

*Primary Examiner*—Chanh Nguyen
*Attorney, Agent, or Firm*—Seed & Berry LLP

[57] ABSTRACT

A current controlled field emission display includes a pair of pulsed transistors that charge and discharge capacitance within the field emission display. The capacitance may be a separate circuit element or may be the parasitic capacitance of the integrated transistors and related circuitry. Various circuit configurations are employed to control charge transfer to and from the capacitance. The control circuit is driven by a series of pulse pairs where the first pulse in each pair controls charging of the capacitance and the second pulse controls discharging of the capacitance through the emitter set.

14 Claims, 6 Drawing Sheets

FIELD EMISSION DISPLAY HAVING PULSED CAPACITANCE CURRENT CONTROL

STATEMENT AS TO GOVERNMENT RIGHTS

This invention was made with government support under Contract No. DABT-63-93-C-0025 by Advanced Research Projects Agency ("ARPA"). The government has certain rights to this invention.

TECHNICAL FIELD

The present invention relates to field emission displays, and more particularly to emitter current control circuits in field emission displays.

BACKGROUND OF THE INVENTION

Flat panel displays are widely used in a variety of applications, including computer displays. One type of device well-suited for such applications is the field emission display. Field emission displays typically include a general planar substrate having an array of projecting emitters. In many cases, the emitters are conical projections integral to the substrate. Typically, the emitters are grouped into emitter sets where the bases of the emitters are commonly connected.

A conductive extraction grid is positioned above the emitters and driven with a voltage of about 30 V–120 V. The emitter sets are then selectively activated by providing a current path from the bases to the ground. Providing a current path to ground allows electrons to be drawn from the emitters by the extraction grid voltage. If the voltage differential between the emitters and extraction grid is sufficiently high, the resulting electric field extracts electrons from the emitters.

The field emission display also includes a display screen mounted adjacent the substrate. The display screen is formed from a glass plate coated with a transparent conductive material to form an anode biased to about 1–2 kV. A cathodoluminescent layer covers the exposed surface of the anode. The emitted electrons are attracted by the anode and strike the cathodoluminescent layer, causing the cathodoluminescernt layer to emit light at the impact site. The emitted light then passes through the anode and the glass plate where it is visible to a viewer.

The brightness of the light produced in response to the emitted electrons depends, in part upon the rate at which electrons strike the cathodoluminescent layer, which in turn depends upon the magnitude of current flow to the emitters. The brightness of each area can thus be controlled by controlling the current flow to the respective emitter set. By selectively controlling the current flow to the emitter sets, the light from each area of the display can be controlled and an image can be produced. The light emitted from each of the areas thus becomes all or part of a picture element or "pixel."

Typically, current flow to the emitter sets is controlled by controlling the voltage applied to the bases of the emitter sets to produce a selected voltage differential between the emitters and the extraction grid. The electric field intensity between the emitters and the extraction grid is then the voltage differential divided by the distance between the emitters and the extraction grid. The magnitude of the current to the emitter sets then corresponds to the intensity of the electric field.

One problem with the above-described approach is that the response of the emitter sets to applied grid and emitter voltages may be non-uniform. Typically, this is caused by variations in the separation between the emitters and extraction grid across the array, which causes differences in the electric field intensity for a given voltage difference. Often, these variations result from variations in the diameter of apertures into which the emitters project, which in turn, are caused by processing variations. Consequently, for a given voltage differential between the emitters and the extraction grid, the brightness of the emitted light may vary according to the location of the emitters.

SUMMARY OF THE INVENTION

A control circuit employs controlled charging and discharging of a capacitive element in a field emission display for displaying an image in response to an image signal. In a preferred embodiment, the field emission display includes an array of emitters surrounded by an extraction grid and controlled by an emitter current control circuit. The current control circuit establishes the current available to the emitters to control the emission of electrons from the emitters. The emitted electrons travel from the emitters through the extraction grid toward a transparent conductive anode at a much higher voltage than the voltage of the extraction grid. Electrons traveling toward the anode strike a cathodoluminescent layer, causing light to be emitted at the impact site. Because the brightness of the light depends upon the rate at which electrons are emitted by the emitters, the current control circuit controls the brightness of the light by controlling the current flow to the emitters.

In one embodiment, the current control circuit includes a serially connected pair of NMOS transistors connected between a column line and an emitter set. The first NMOS transistor is a charging transistor coupled between the column line and a common node joining the pair of NMOS transistors. The second NMOS transistor is a driving transistor coupled between the common node and the emitter set.

A charging signal and driving signal control the charging and driving transistors, respectively. The charging and driving signals are pulsed signals having one or more pulses during an activation interval of the respective emitter set. The charging and driving signals are identical, except that the driving signal is phase delayed with respect to the charging signal, such that only one of the charging and driving transistors conducts at any time.

In response to a pulse of the charging signal, the charging transistor couples the column line to the common node, such that the common node is driven to the voltage of the column line. Parasitic capacitance in the charging transistor and at the common node stores a charge Q proportional to the voltage of the column line.

Once the parasitic capacitance is charged, the charging signal pulse returns low and the charging transistor is turned OFF, trapping the charge Q on the parasitic capacitance. A pulse of the driving signal then turns ON the driving transistor to couple the common node to the emitter set. The electrons stored in the parasitic capacitance during the charging period are thereby made available to the emitter set. The extraction grid extracts a portion of the available electrons, raising the common node voltage. When the common node voltage equals the driving signal voltage, less the threshold voltage $V_T$ of the driving transistor, the driving transistor turns OFF.

Next, the driving signal pulse goes low, turning the driving transistor further OFF to fully isolate the common node. At this point, the charge Q stored by the parasitic capacitance equals the parasitic capacitance times the new capacitor voltage. The change in charge $\Delta Q$ is the difference between the charge stored at the end of the charging period and the charge remaining after the emission. The charge transferred to the emitter sets in response to the pulse pair is thus proportional to the difference between the driving signal voltage and the column line voltage.

In one embodiment of the invention, several pulses of the charging and driving signals arrive during each activation interval of the emitter set. The total charge transferred to the emitter set is thus equal to the number of pulse pairs times the charge transferred for each pulse pair. The brightness of the pixel can thus be varied by varying the number of pulse pairs during each activation interval. Thus, the brightness of the pixel can be controlled by varying the voltage $V_{COL}$ of column line and/or by varying the number of pulses during each activation interval.

In an alternative embodiment, the amount of charge transferred in response to each pair of pulses is increased by adding a separate capacitive element in the circuit. This allows the capacitance to be more accurately determined for certain applications.

In another alternative embodiment, pass and gating transistors are added to the circuit and controlled by the column and row signals. The charging and driving signals are continuous pulsed signals controlling the charging and driving transistors. The pass and gating transistors selectively allow electrons to pass from the common node to the emitter set while the oscillator-driven charging and driving signals attempt to continuously charge and discharge the parasitic capacitance of the common node.

In another alternative embodiment, the column signal $V_{COL}$ controls the charging and driving transistors while the row signal $V_{ROW}$ provides a reference voltage to supply electrons to the common node.

In another alternative embodiment, the row signal $V_{ROW}$ controls the charging transistor and the column signal controls the driving transistor and provides a reference voltage to supply electrons to the common node.

DETAILED DESCRIPTION OF THE INVENTION

Figure 1:
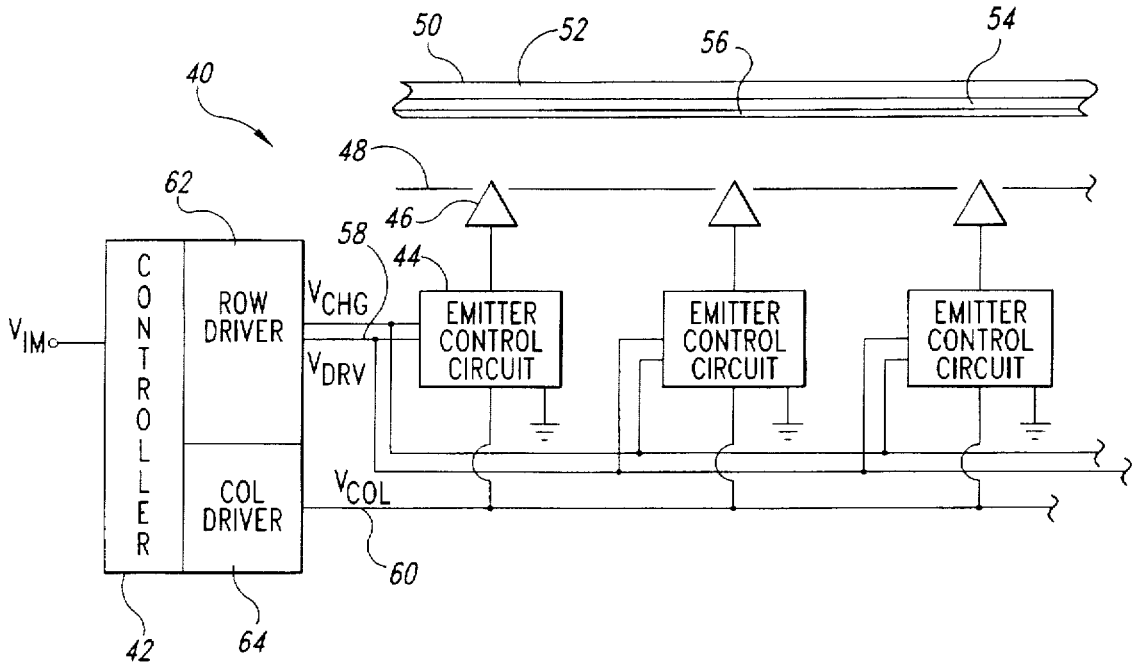
FIG. 1 is a diagrammatic representation of a portion of a field emission display according to the invention showing a group of emitter sets controlled by column and row driver circuits.

As shown in FIG. 1, a display device 40, which may be a television, computer display, or similar device, includes a controller 42 that controls an array of emitter control circuits 44, each coupled to a respective emitter set 46. While the array is represented by only three control circuits 44 and emitter sets 46 for clarity of presentation, it will be understood that typical arrays include several hundred control circuits 44 and emitter sets 46 arranged in rows and columns. Also, each emitter set 46 is represented by a single emitter for clarity, although such emitter sets 46 typically contain more than one emitter.

The emitter sets 46 are aligned with an extraction grid 48 adjacent a screen 50. The extraction grid 48 is a conventional extraction grid formed as a planar conductor having several holes, each aligned with a respective emitter. The screen 50 is a conventional screen formed from a glass plate 52 coated with a transparent, conductive anode 54 which is coated, in turn, by a cathodoluminescent layer 56. As is known, during typical operation, the extraction grid 48 is biased to approximately 100 V and the anode 54 is biased to approximately 1–2 kV.

In operation, a row driver 62 and column driver 64 within the controller 42 activate selected ones of the emitter sets 46 by selectively controlling the respective control circuits 44 through row lines 58 and column lines 60. The control circuits 44 activate the emitter sets 46 by providing electrons to the emitter sets 46. The extraction grid 48 extracts the provided electrons by creating a strong electric field between the extraction grid 48 and the emitter set 46. In response, the emitter set 46 emits electrons that are attracted by the anode 54. The electrons travel toward the anode 54 and strike the cathodoluminescent layer 56 causing light emission at the impact site. Because the intensity of the emitted light corresponds in part to the number of electrons striking the cathodoluminescent layer 56 during a given activation interval, the intensity of light can be controlled by controlling the electron flow to the emitter set 46.

Control of electron flow by the emitter control circuit 44 will now be described with reference to FIGS. 2, 3A and 3B. As shown in FIG. 3A, the control circuit 44 is formed from a driving NMOS transistor 66 and charging NMOS transistor 68 serially coupled at a common node 69 between the column line 60 and the emitter set 46. The emitter control circuit 44 is controlled by three signals from the controller 42. First, the column driver 64 provides a column signal $V_{COL}$ with a variable magnitude in response to an image signal $V_{IM}$. The column signal $V_{COL}$ is represented in the lower portion of FIG. 2, where the broken lines represent the variability of the magnitude.

The row driver 62 provides a pair of pulsed row signals $V_{ROW}$. The first row signal $V_{ROW}$ will be referred to herein as the charging signal $V_{CHG}$ and the second row signal $V_{ROW}$ will be referred to as the driving signal $V_{DRV}$. In later discussed embodiments, the charging and driving signals $V_{CHG}$, $V_{DRV}$ do not necessarily come from the row driver 62, and the row signals $V_{ROW}$ are used for other functions. Accordingly, the terms charging signal $V_{CHG}$ and driving signal $V_{DRV}$ will be used herein to refer to signals initiating charging of the common node 69 and discharging of the common node 69, respectively. The terms row signal $V_{ROW}$ and column signal $V_{COL}$ will refer to signals from the controller 42 for controlling row and column activation.

Figure 2:
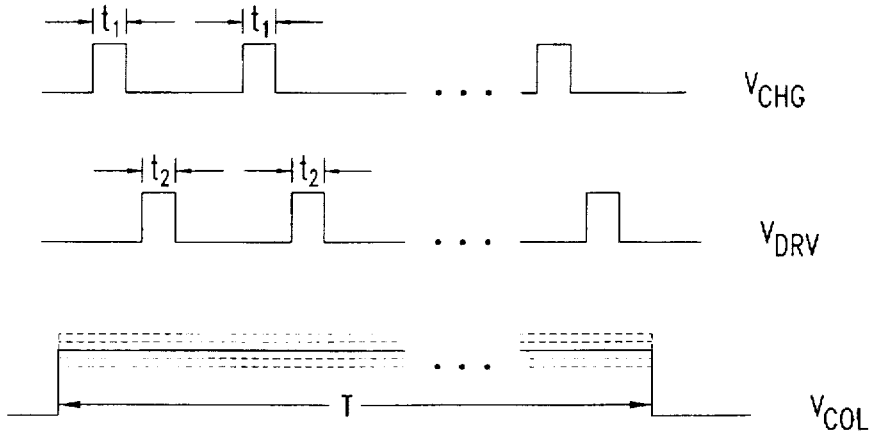
FIG. 2 is a timing diagram showing the relative timing of the charging and driving signals and a variable column signal for controlling an emitter set of the display of FIG. 1.
Figure 3A:
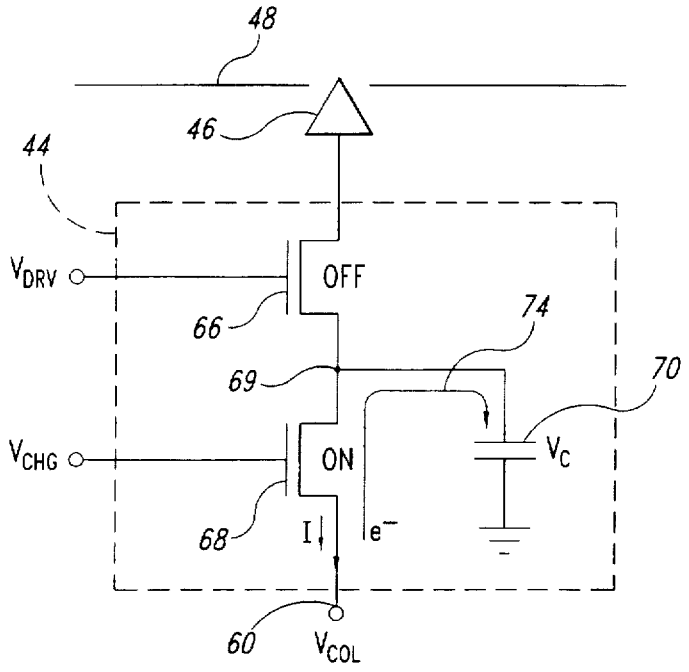
FIG. 3A is a schematic of one of the current control circuits of FIG. 2 coupled to an emitter set showing electron flow for charging during a charging interval $t_1$.

The charging and driving signals $V_{CHG}$, $V_{DRV}$ are identical, except that the driving signal $V_{DRV}$ is phase delayed with respect to the charging signal $V_{CHG}$, such that both signals $V_{CHG}$, $V_{DRV}$ will not be high at the same time, as can be seen in FIG. 2.

The gate of the charging transistor 68 is controlled by the charging signal $V_{CHG}$ such that the charging transistor is ON only during a charging interval $t_1$ when the charging signal $V_{CHG}$ is high. The gate of the driving transistor 66 is controlled by the driving signal $V_{DRV}$ such that the driving transistor 66 is ON only during a driving interval $t_2$ different from the charging interval $t_1$. Because the driving signal $V_{DRV}$ is delayed with respect to the charging signal $V_{CHG}$, the charging and driving intervals $t_1$, $t_2$ do not overlap, and only one of the transistors 66, 68 is ON at any time.

The remaining element of the control circuit 44 is a circuit capacitance represented as a capacitor 70 connected between the common node 69 and ground. The capacitor 70 preferably is not a separate circuit element. When the transistors 66, 68 are integrated into a substrate (not shown in FIG. 3), parasitic capacitances are inherent at the common node 69. Cumulatively, the parasitic capacitances provide sufficient capacitance for operation of the control circuit 44, because of the low current requirements of the emitter set 46. For convenience of presentation, the effects of the parasitic capacitances are represented as the single capacitor 70 in FIGS. 3A and 3B.

The operation of the control circuit 44 will now be described. First, the column driver 64 (FIG. 1) sets the magnitude of the column signal $V_{COL}$ at a voltage level inversely proportional to the intensity of the image signal $V_{IM}$ (FIG. 1). Then, during the charging interval $t_1$, the charging signal $V_{CHG}$ is high, turning the charging transistor 68 ON. At the same time, the driving signal is low turning the driving transistor 66 OFF, such that the driving transistor 66 presents an open circuit. The charging transistor 68 thus couples the column signal $V_{COL}$ to the common node 69, pulling the capacitor voltage $V_C$ down to the voltage of the column signal $V_{COL}$. As will be explained hereinafter, prior to the charging interval $t_1$, the capacitor voltage $V_C$ is higher than the column voltage $V_{COL}$. Consequently, when the charging transistor 68 is ON, electrons flow from the column line 60 to the capacitor 70, as indicated by the arrow 74.

At the end of the charging interval $t_1$, the charging signal $V_{CHG}$ returns low and both transistors 66, 68 are OFF. Because the transistors 66, 68 are NMOS transistors having extremely low current leakage, the charge Q on the capacitor 70 is trapped and the capacitor voltage $V_C$ remains constant at the voltage of the column signal $V_{COL}$.

Figure 3B:
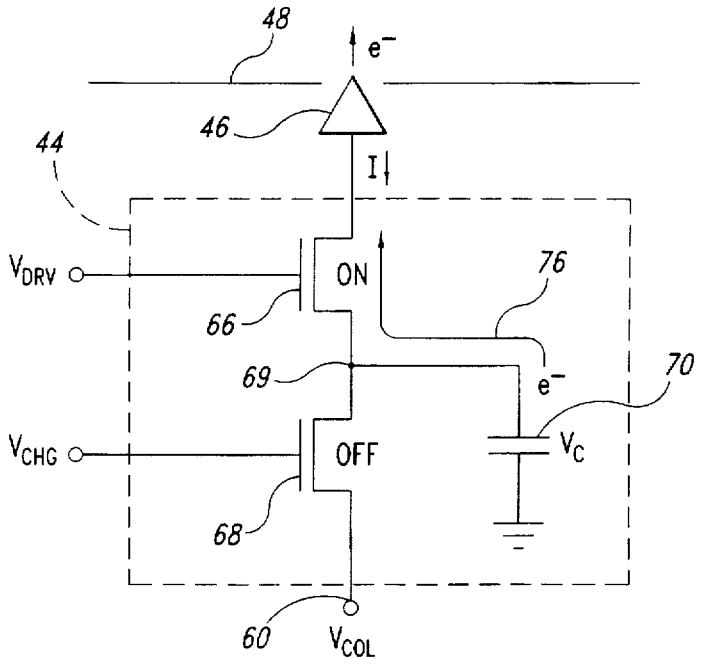
FIG. 3B is a schematic of the current control circuit of FIG. 3A showing electron flow for electron emission during a driving interval $t_2$.

Next, during the driving interval $t_2$, the driving signal $V_{DRV}$ goes high and turns ON the driving transistor 66, as represented in FIG. 3B. By this time, the charging signal $V_{CHG}$ is low such that the charging transistor 68 is OFF, isolating the column line 60 from the common node 69. Because the driving transistor 66 is ON, the driving transistor 66 couples the electrons from the capacitor 70 to the emitter set 46, as indicated by the arrow 76. The electric field between the extraction grid 48 and the emitters in the emitter set 46 extracts electrons from the emitter set 46.

As electrons are extracted from the emitter sets 46 and electrons stored in the capacitor 70 are depleted, the capacitor voltage $V_C$ rises and approaches the driving voltage $V_{DRV}$. When the difference between the capacitor voltage $V_C$ and the driving voltage $V_{DRV}$ is less than the threshold voltage $V_T$ of the driving transistor 66, the driving transistor 66 turns OFF. For example, for a driving voltage $V_{DRV}$ of 5 V, a column voltage $V_{COL}$ of 2 V, and a threshold voltage $V_T$ of 1 V, the capacitor voltage $V_C$ will go from 2 V ($V_{COL}$) to 4 V ($V_{DRV}-V_T$). The change in voltage $\Delta V_C$ across the capacitor 70 will then equal 2 V. The total charge from electrons emitted by the emitter sets 46 equals the change in voltage $\Delta V_C$ times the capacitance C of the capacitor 70 ($\Delta Q=C\Delta V_C=C(2\ V)$) which is in turn a function of the difference between the voltages of the driving signal $V_{DRV}$ and the column signal $V_{COL}$. Thus, the number of electrons emitted in response to each pair of pulses can be controlled by controlling the voltages of the column and row signals $V_{COL}$, $V_{ROW}$, because the row signal $V_{ROW}$ is the driving signal $V_{DRV}$.

As an alternative or complement to controlling the brightness by controlling the voltages of the column signal $V_{COL}$ and row signal $V_{ROW}$, the brightness can be controlled by controlling the number of pulse pairs in a given time period. As shown in FIG. 2, an activation interval T defines the time over which an emitter set 46 is activated. That is, the activation interval T is the time during which the column signal $V_{COL}$ is available on the column line 60. The activation interval T is substantially longer than the charging and driving intervals $t_1$, $t_2$. Consequently, several pairs of pulses can arrive within one activation interval T, allowing the capacitor 70 to charge and discharge several times. The total transferred charge $Q_{TOT}$ in the activation interval T will be equal to the number N of pulse pairs times the capacitance C of the capacitor 70 times the change in the capacitor voltage $\Delta V_C$. Thus, for a given voltage change, the number of electrons emitted by the emitter set 46 can be controlled by varying the number of pulse pairs N within the interval T and/or by controlling the voltage of the column signal $V_{COL}$.

Figure 4A:
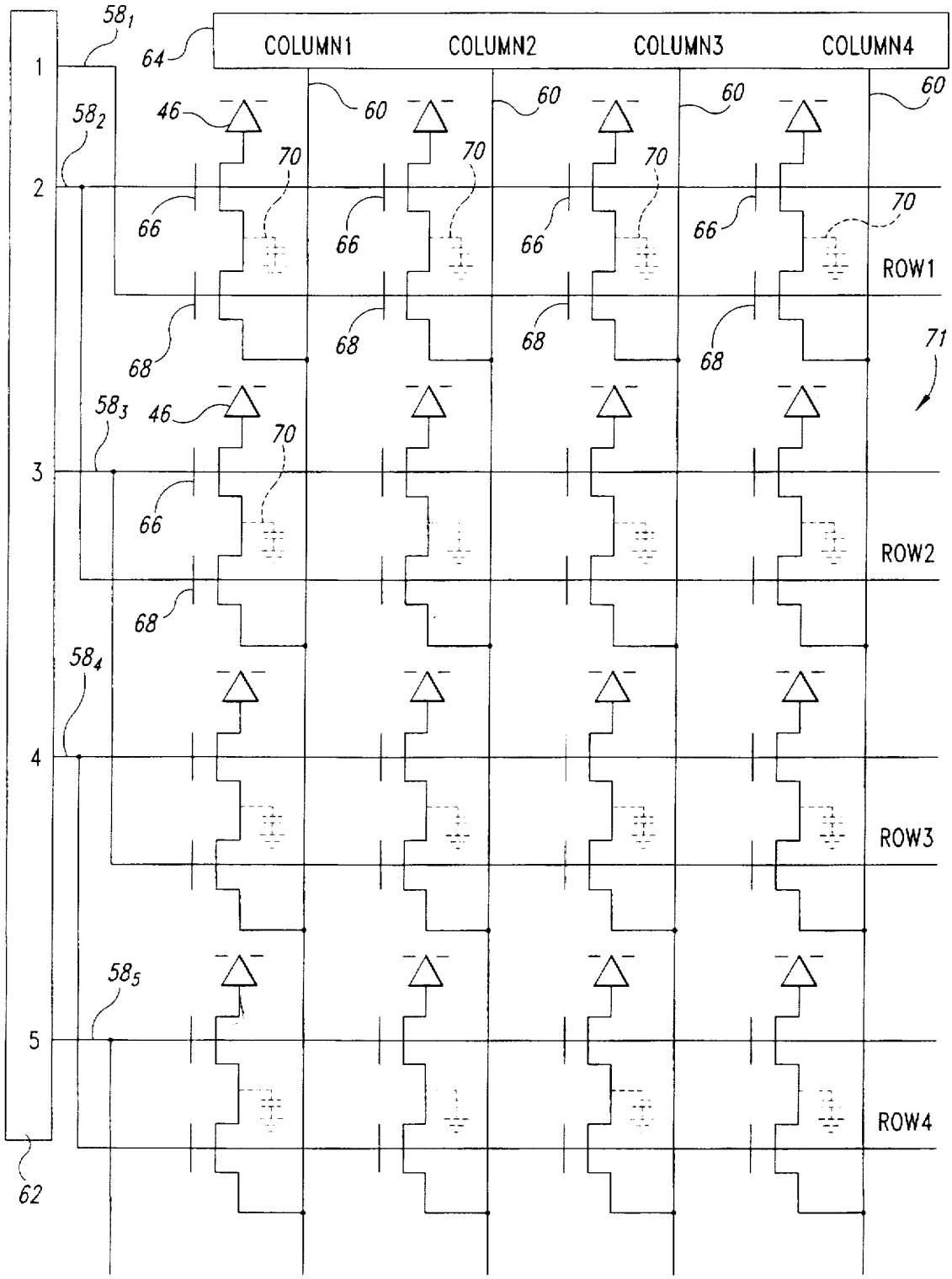
FIG. 4A is a diagrammatic representation of a portion of a matrix of emitters and control circuits according to the preferred embodiment of the invention.

FIG. 4A shows one interconnect structure for driving four rows and four columns of an array 71 according to the above-described approach. As represented in FIG. 4A, the row driver 62 produces the driving and charging signals $V_{DRV}$, $V_{CHG}$ as sequences of pulses on five row lines $58_1$–$58_5$, where the respective timing of the pulse sequences is presented in FIG. 4B. The column signals $V_{COL}$ are provided by the column driver 64 in response to the image signal $V_{IM}$ (FIG. 1) on the column lines 60.

Figure 4B:
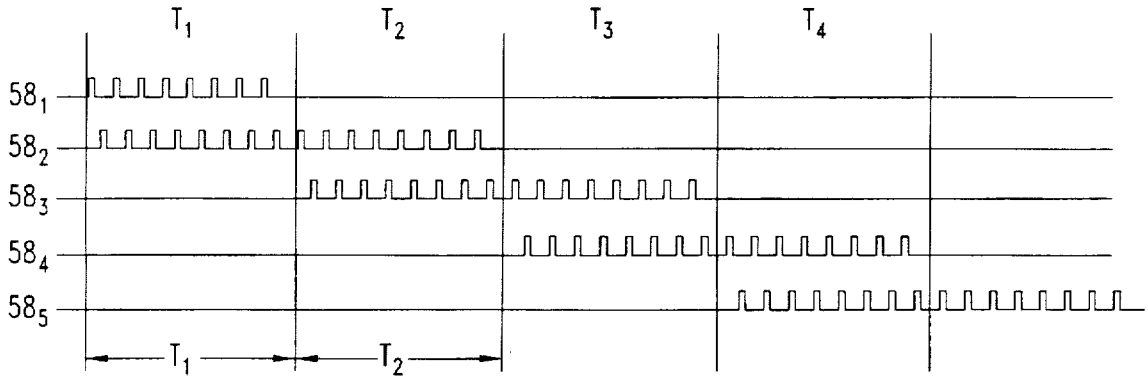
FIG. 4B is a signal timing diagram showing timing of row signals within the array of FIG. 4A.
Figure 4C:
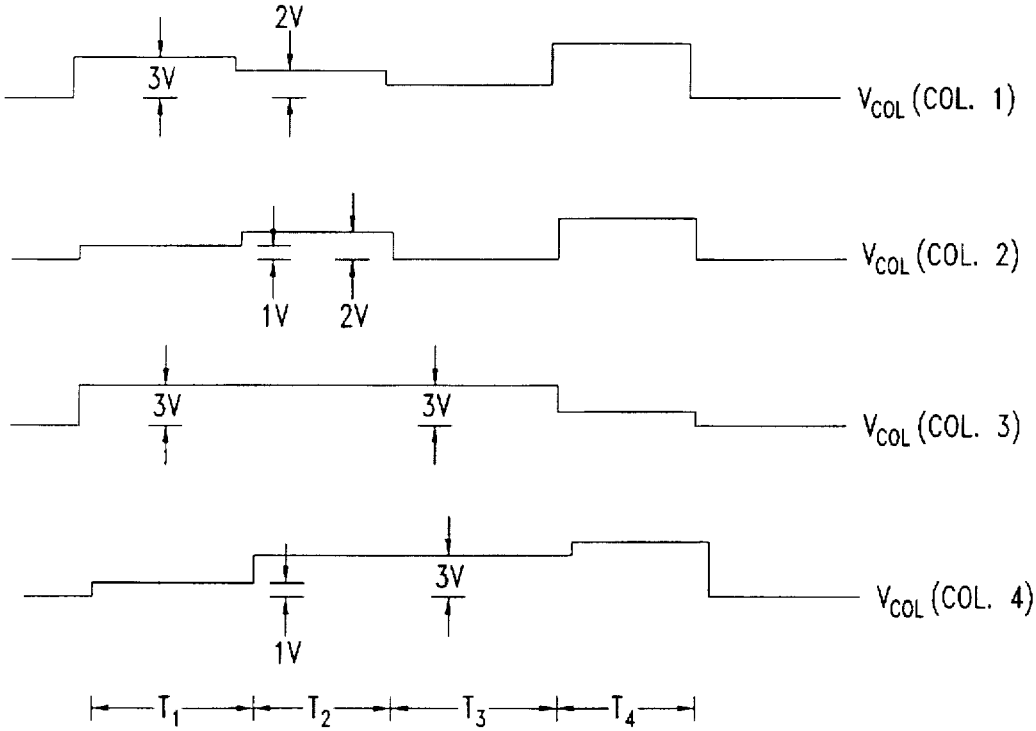
FIG. 4C is a signal timing diagram showing column signals within the array of FIG. 4A.

As shown in FIG. 4C, the column driver 64 supplies column signals $V_{COL}$ to each of the column lines 60 at the beginning of the first activation interval $T_1$. Then, the row driver 62 provides a sequence of pulses as the charging signal $V_{CHG}$ on the first row line $58_1$, thereby periodically charging the capacitors 70 in the first row. The row driver 62 also provides a second series of pulses, phase delayed with respect to the first series of pulses, as the driving signal $V_{DRV}$ to the second row line $58_2$ to periodically discharge the capacitors 70 through the driving transistors 66 and emitter sets 46. As shown in FIG. 4B, eight pairs of pulses drive the transistors 66, 68 during the first activation interval $T_1$. Because the charge Q transferred in response to each pulse pair is equal to the capacitance C times the change in voltage $\Delta V$, as described above, the transferred charge $Q(T_1)$ during the interval $T_1$ is:

$$\Delta Q(T_1)=8\times C\times\Delta V.$$

As described above, the change in voltage $\Delta V$ is controlled by the column voltage $V_{COL}$ and the row voltage $V_{ROW}$. As shown in FIG. 4C, the voltages on the column lines 60 are 3 V (Col. 1), 1 V (Col. 2), 3 V (Col. 3), and 1 V (Col. 4). For a driving voltage of 4 V and a threshold voltage of 1 V, the changes in capacitor voltage ($\Delta V_C$) for the four capacitors 70 are 1 V (Col. 1), 3 V (Col. 2), 1 V (Col. 3), and 3 V (Col. 4), respectively. During the first activation interval $T_1$ the total change in charge $\Delta Q$ for the first column is then 8×C. For the second, third and fourth columns, the total change in charge $\Delta Q$ is 24×C, 8×C and 24×C, respectively.

The second row line $58_2$ also drives the charging transistors 68 in the third row. Consequently, during the first activation interval $T_1$, the row driver 62 also provides the phase delayed pulses (second signal diagram of FIG. 4B) to the charging transistors 68 in the second row. However, because the driving transistors 66 in the second row receive no input pulses, no charge is transferred to the emitter sets 46 in the second row during the first activation interval $T_1$.

During the second activation interval $T_2$, the row driver 62 stops the series of pulses to the charging transistors 68 in the first row and provides a series of pulses to the driving transistors 66 in the second row on the third row nine $58_3$. Meanwhile, the pulses to the charging transistors 68 in the second row continue on the second row line $58_2$. As seen in FIG. 4B, the second and third row lines $58_2$, $58_3$ receive eight pairs of pulses during the second activation interval $T_2$. The charging and driving transistors 66, 68 in the second row thus turn ON and OFF eight times during the second activation interval $T_2$. At the same time, the column lines 60 have respective column voltages of 2 V, 2 V, 3 V, and 3 V. The total charge $\Delta Q$ transferred to and from the respective capacitors 70 to their corresponding emitter sets 46 is eight times the change in capacitor voltage $\Delta V_C$, as described above. Thus, the charge emitted by the respective emitter sets 46 during the second activation interval $T_2$ is 16×C, 16×C, 8×C, and 8×C, for the first through fourth columns, respectively.

During the third and fourth activation intervals $T_3$, $T_4$, the remaining rows of the array are similarly controlled using respective series of pulses on row lines $58_3$–$58_5$ and corresponding column voltages $V_{COL}$. The column signal $V_{COL}$ and five sets of pulses from the row driver 62 thus sequentially activate the emitter sets 46 in four rows of the array during the four activation intervals $T_1$, $T_2$, $T_3$, $T_4$.

Figure 5A:
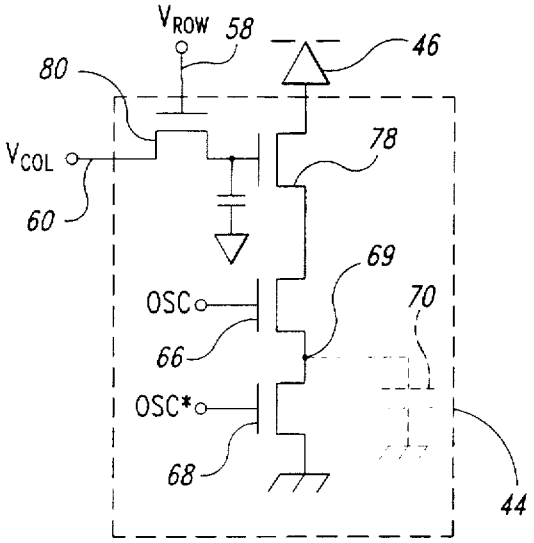
FIG. 5A is a schematic of a first alternative embodiment of the control circuit having row, column, oscillator and complementary oscillator inputs.

While the preferred embodiment of FIGS. 3A, 3B and 5A includes a serially connected pair of NMOS transistors between the column line 60 and the emitter sets 46, various other configurations of the control circuit 44 are within the scope of the invention. For example, as shown in the alternative control circuits 44 of FIGS. 5A and 5B, a gating transistor 78 and pass transistor 80 may be added to the control circuit 44 to simplify the clocking of the charging transistors 68 and driving transistor 66. In each of these embodiments, the column signal $V_{COL}$ is a variable level pulsed signal from the column line 60 and the row signal $V_{ROW}$ is a two-level pulsed (high, low) signal from the row lines 58, as shown in FIG. 5C. At the start of an activation interval T, the column driver 64 (FIG. 1) provides the column signal $V_{COL}$ to the pass transistor 80. Then, the row driver 62 (FIG. 1) supplies the row signal $V_{ROW}$ to the pass transistor 80 to turn ON the pass transistor 80, thereby providing the column signal $V_{COL}$ to the gate of the gating transistor 78. The row voltage $V_{ROW}$ then goes low, turning OFF the pass transistor 80 and trapping the column voltage $V_{COL}$ on the gate of the gating transistor 78. The gating transistor continues to conduct current as dictated by the magnitude of the column voltage $V_{COL}$ pulse.

The charging transistor 68 and driving transistor 66 are driven by continuously pulsed oscillator signals OSC, OSC*, where the oscillator signal OSC applied to the driving transistor 66 is delayed with respect to the oscillator signal OSC* applied to the charging transistor 68.

In the circuit of FIG. 5A, the charging transistor 68 transfers charge from ground to the capacitor 70 during the charging period $t_1$. Then the driving transistor 66 attempts to transfer charge from the capacitor 70 through the gating transistor 78 to the emitter set 46, as discussed above. However, charge can only transfer through the gating transistor 78 when the gating transistor 78 is ON. The gating transistor 78 is ON when the column voltage $V_{COL}$ exceeds the capacitor voltage $V_C$ by the threshold voltage $V_T$ of the gating transistor 78 and $V_{ROW}$ is greater than the sum of the threshold voltage $V_T$ of the pass transistor 80, the threshold voltage $V_T$ of the gating transistor 78 and the voltage on the capacitor 70. The capacitor voltage $V_C$ will thus rise to either the voltage of the column signal $V_{COL}$ minus the threshold voltage $V_T$ of the gating transistor 78 or the voltage of the row signal $V_{ROW}$ minus the threshold voltage $V_T$ of the gating transistor 78 and the threshold voltage $V_T$ of the pass transistor 80. For example, for a column signal voltage of 5 V and threshold voltage $V_T$ of 1 V, the capacitor voltage $V_C$ will rise to 4 V.

Note that the column signal $V_{COL}$ only reaches the gating transistor 78 when the pass transistor 80 is ON. Otherwise, the gate of the gating transistor 78 is isolated. Consequently, once the pass transistor 80 is OFF, the gate voltage of the gating transistor 78 is fixed. Thus, once the gate voltage of the gating transistor 78 is established and the pass transistor 80 turns OFF, current flow through the gating transistor 78 will be controlled solely by the capacitor voltage $V_C$. The column voltage $V_{COL}$ can then be varied to control other emitter sets 46 in the column without affecting current flow to this emitter set 46. If the column voltage $V_{COL}$ is high, the gating transistor 78 will remain ON until the capacitor voltage $V_{COL}$ approaches the trapped gate voltage. During this period, the emitter set 46 will continue emitting electrons as long as the oscillator signals OSC, OSC* continue, even after the column signal $V_{COL}$ is removed from the column line 60. The row and column drivers 62, 64 thus control transfer of charge from ground, through the transistors 66, 68, 78 by controlling the row and column signals $V_{ROW}$, $V_{COL}$.

Figure 5B:
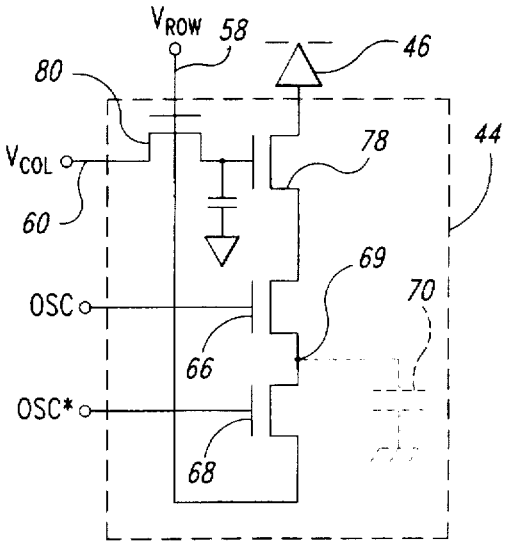
FIG. 5B is a schematic of a second alternative embodiment of the control circuit having row, column, oscillator and complementary oscillator inputs, with the ground reference eliminated.
Figure 5C:
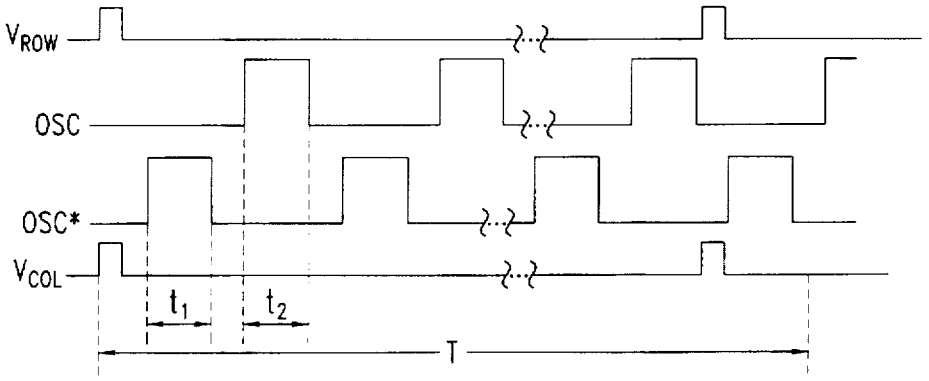
FIG. 5C is a timing diagram showing row, column, oscillator and complementary oscillator signals for the circuits of Figures 5A and 5B.

The control circuit 44 of FIG. 5B is substantially identical to the circuit of FIG. 5A, except that the input to the charging transistor 68 is the row signal $V_{ROW}$ rather than ground. The row driver 62 then supplies electrons to charge the capacitor 70 when the complementary oscillator signal OSC* is high. This allows the row driver 62 to control the voltage level of the capacitor 70. As can be seen from the above discussion, the change in capacitor voltage $\Delta V_C$ will thus be the difference between the column voltage $V_{COL}$ and the row voltage $V_{ROW}$, minus the threshold voltage $V_T$ of the gating transistor 78. Thus, the amount of charge transferred in response to each pulse pair can be controlled by controlling the difference between the row and column voltages.

Figure 6A:
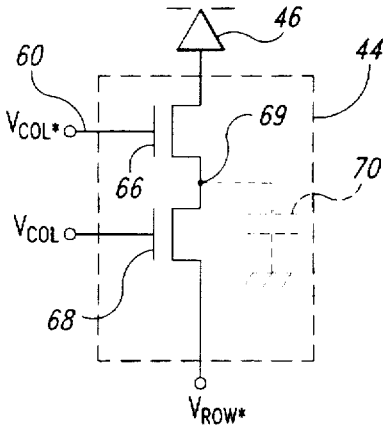
FIG. 6A is a schematic of an alternative embodiment of the invention controlled by column, complementary column and complementary row signals.
Figure 6B:
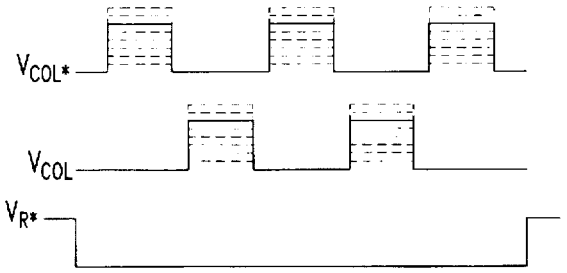
FIG. 6B is a timing diagram of signals for driving the circuit of FIG. 6A.

FIG. 6A shows a third alternative embodiment of the control circuit 44, where the structure of the control circuit 44 is identical to that of FIG. 3. Unlike the control circuit 44 of FIG. 3, in the control circuit 44 of FIG. 6A, the gates of the driving transistor 66 and charging transistor 68 are driven by the column signal $V_{COL}$ and a delayed version of the column signal $V_{COL*}$, respectively. Also, the input to the charging transistor 68 is a complementary row signal $V_{ROW*}$ which is a low true version of the row signal $V_{ROW}$. As shown in FIG. 6B, the circuit of FIG. 6A is operated by setting the complementary row signal $V_{ROW}$ low and then driving the transistors 66, 68 with pulsed column signals $V_{COL}$, $V_{COL*}$ of varying amplitudes. The voltage change $\Delta Q$ across the capacitor 70 is controlled by the difference between the voltage of the complementary row signal $V_{ROW*}$ and the column signal $V_{COL}$, because the column signal $V_{COL}$ sets the gate voltage of the driving transistor 66 and the complementary row signal $V_{ROW*}$ sets the capacitor voltage $V_C$ during charging. To vary the brightness of the pixel, the analog level of the column signals $V_{COL}$, $V_{COL*}$ is varied, as indicated by the broken lines in FIG. 6B. Alternatively, the level of the column signal $V_{COL}$ and complementary column signal $V_{COL*}$ can be fixed and the level of the complementary row signal $V_{ROW*}$ can be varied.

Figure 7A:
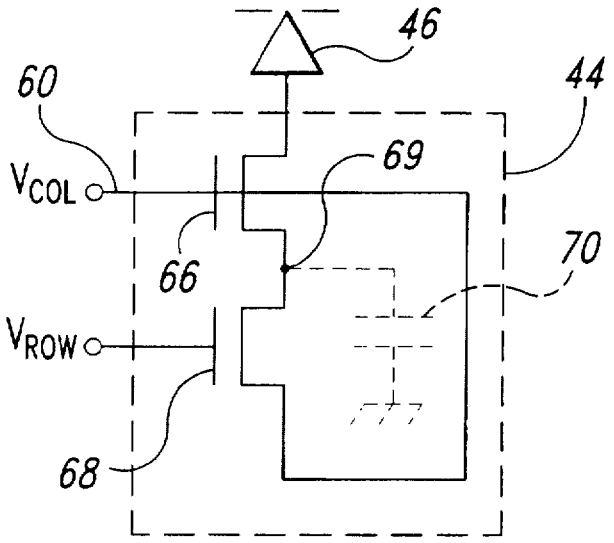
FIG. 7A is a schematic of an alternative embodiment of the invention controlled by row and column signals with a ground reference eliminated.
Figure 7B:
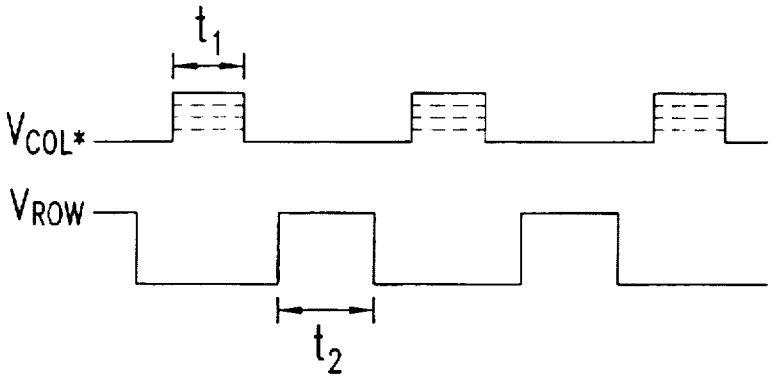
FIG. 7B is a signal timing diagram of signals for driving the circuit of FIG. 7A.

FIG. 7A shows a fourth alternative embodiment of the control circuit 44 utilizing only the column signal $V_{COL}$ and the row signal $V_{ROW}$. As shown in FIG. 7B, the row signal $V_{ROW}$ drives the gate of the charging transistor 68 with a series of fixed amplitude pulses. The column signal $V_{COL}$ drives the gate of the driving transistor 66 with a series of variable amplitude pulses, delayed with respect to the row signal $V_{ROW}$. The column signal $V_{COL}$ also provides the variable amplitude pulses as input to source of the charging transistor 68 to control the gate voltage and to provide electrons to the capacitor 70. The charging interval $t_1$ occurs when the column signal $V_{COL}$ is low and the row signal $V_{ROW}$ is high. During the charging interval $t_1$, the voltage $V_C$ of the capacitor 70 goes to the fully low column signal voltage.

Once the voltage $V_C$ of the capacitor 70 equals the fully low voltage of the column signal $V_{COL}$, the row signal $V_{ROW}$ returns low, thereby isolating the common node 69. Then, the column signal $V_{COL}$ goes to the variable high level, turning ON the driving transistor 66 to couple the common node 69 to the emitter set 46. During the driving interval $t_2$, the capacitor 70 supplies electrons to the emitter set 46 until the capacitor voltage $V_C$ rises from the fully low voltage to the variable high voltage minus the threshold voltage $V_T$ of the driving transistor 66. Then, the driving transistor 66 turns OFF as its gate-to-source voltage no longer exceeds the threshold voltage $V_T$. The change in voltage across the capacitor 70 is thus the difference between the fully low column signal voltage and the variable high column signal voltage, minus the threshold voltage $V_T$ of the driving transistor 66.

While the principles of the invention have been illustrated by describing various structures for controlling current to the emitter sets 46, various modifications may be made without deviating from the spirit and scope of the invention. Accordingly, the invention is not limited except as by the appended claims.

We claim:

1. An integrated current control circuit for driving an emitter set in a field emission display with stored charge from a circuit capacitance, comprising:

a charging signal source producing a charging signal;

a driving signal source producing a driving signal phase delayed with respect to the charging signal;

a first circuit portion coupled to receive the charging signal and to charge the circuit capacitance in response to the charging signal; and a second circuit portion coupled between the circuit capacitance and the emitter set, the second circuit portion further being coupled to receive the driving signal and to supply a portion of the stored charge to the emitter set in response to the driving signal, wherein the first and second circuit portions are transistors having serially coupled current paths extending between the emitter set and the reference potential.

2. The driving circuit of claim 1 wherein the circuit capacitance comprises a parasitic capacitance of the first and second transistors.

3. The driving circuit of claim 2 wherein the driving signal source and charging signal source are pulsed signal sources such that the driving signal and charging signal are pulsed signals.

4. The current control circuit of claim 2, further including a gating circuit coupled between the second circuit portion and the emitter set, the gating circuit being responsive to a control signal to selectively block or transmit electrons from the second circuit portion to the emitter set.

5. The current control circuit of claim 4 wherein the control signal is a column signal, further including a pass transistor coupled to receive a row signal, the pass transistor selectively providing the column signal to the gating transistor in response to the row signal.

6. A field emission display, comprising:

an emitter set;

an electron source;

a charging signal source producing a charging signal;

a driving source producing a driving signal, phase delayed with respect to the charging signal;

charging and driving circuits serially coupled between the emitter set and the electron source, the charging and driving circuits being coupled at a common node, the charging circuit being coupled to receive the charging signal and to supply electrons from the electron source to the common node in response to the charging signal, and the driving circuit being coupled to receive the driving signal and to transmit the supplied electrons from the common node to the emitter set in response to the driving signal; and further including a gating circuit coupled between the driving circuit and the emitter set, the gating circuit selectively blocking the driving circuit from transferring electrons to the emitter set in response to a control signal.

7. The field emission display of claim 6, further including a pass circuit coupled to supply the control signal to the gating circuit.

8. The field emission display of claim 7 wherein the control signal is a column signal and the pass signal is a row signal, and wherein the electron source includes a conductor coupled to provide the row signal to the driving circuit.

9. A method of supplying a controlled charge to an emitter in a field emission display, the field emission display including a charging circuit and a driving circuit coupled between an electron source and the emitter set, the field emission display further including a circuit capacitance, comprising the steps of:

providing electrons at an electron source;

activating the charging circuit to transfer electrons from the electron source to the circuit capacitance to charge the circuit capacitance;

deactivating the charging circuit after the capacitance is charged to a predetermined level;

activating the driving circuit to transfer stored electrons from the circuit capacitance to the emitter; and deactivating the driving circuit after a portion of the stored charge is transferred from the circuit capacitance to the emitter, wherein the step of activating the charging circuit to transfer electrons comprises supplying a first clock signal to the charging circuit and wherein the step of activating the driving circuit to transfer charge from the circuit capacitance to the emitter comprises supplying a second clock signal phase shifted with respect to the first clock signal to the second control circuit.

10. The method of claim 9 wherein the circuit capacitance is a parasitic capacitance of the charging and driving circuits.

11. The method of claim 9 wherein the field emission display further includes a gating circuit coupled between the driving circuit and the emitter, comprising the step of providing a column signal to the gating circuit to selectively pass or block the driving circuit from transferring electrons to the emitter.

12. The method of claim 11 wherein the field emission display further includes a pass circuit coupled between a column line and the gating circuit, wherein the step of providing the column signal to the gating circuit includes the step of selectively activating the pass circuit to couple the column signal to the gating circuit.

13. The method of claim 12 wherein the step of activating the pass circuit includes providing a row signal to the pass circuit.

14. The method of claim 13 wherein the step of providing electrons at an electron source includes coupling the row signal to the charging circuit.

* * * * *

UNITED STATES PATENT AND TRADEMARK OFFICE

CERTIFICATE OF CORRECTION

PATENT NO. : 5,894,293
DATED : April 13, 1999
INVENTOR(S) : Hush et al.

It is certified that error appears in the above-indentified patent and that said Letters Patent is hereby corrected as shown below:

| | | |
|---|---|---|
| Column 7, line 32 | "nine" | - - line - - |

Signed and Sealed this

Eighth Day of May, 2001

*Attest:*

Nicholas P. Godici

NICHOLAS P. GODICI

*Attesting Officer*

*Acting Director of the United States Patent and Trademark Office*